US009543673B2

(12) United States Patent
Kim

(10) Patent No.: US 9,543,673 B2
(45) Date of Patent: Jan. 10, 2017

(54) CONNECTING PIN FOR ELECTRONIC CIRCUIT BOARDS

(71) Applicant: Hyundai Motor Company, Seoul (KR)

(72) Inventor: Do Seop Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 5 days.

(21) Appl. No.: 14/510,956

(22) Filed: Oct. 9, 2014

(65) Prior Publication Data

US 2015/0255901 A1 Sep. 10, 2015

(30) Foreign Application Priority Data

Mar. 4, 2014 (KR) ..... 10-2014-0025338

(51) Int. Cl.
*H01R 12/58* (2011.01)

(52) U.S. Cl.
CPC ..... *H01R 12/585* (2013.01)

(58) Field of Classification Search
CPC ..... H01L 2924/00; H01L 2224/81899; H01L 2224/13017; H01L 2224/1601; H01L 2224/16059; H01R 12/58; H01R 12/585; H05K 2201/10401; H05K 2201/1059; H05K 2201/10303; H05K 2201/10871
USPC ..... 439/82, 751, 78, 83, 931, 81, 571, 387
See application file for complete search history.

(56) References Cited

U.S. PATENT DOCUMENTS

| | | | | |
|---|---|---|---|---|
| 3,654,583 | A * | 4/1972 | Mancini | H01R 9/091 174/263 |
| 4,570,338 | A * | 2/1986 | Ignatowicz | H05K 3/308 29/843 |
| 6,217,346 | B1 | 4/2001 | Cubon | |
| 7,377,823 | B2 | 5/2008 | Chen | |
| 7,473,111 | B2 * | 1/2009 | Konishi | H01R 12/58 439/82 |
| 8,985,925 | B2 * | 3/2015 | Lan | F16B 33/004 411/180 |
| 2003/0045139 | A1 * | 3/2003 | Hanson | H01R 13/6658 439/82 |
| 2010/0175811 | A1 * | 7/2010 | Kumai | B29C 65/44 156/91 |
| 2011/0287643 | A1 * | 11/2011 | Lopez | H02G 3/0616 439/100 |

(Continued)

FOREIGN PATENT DOCUMENTS

| | | | |
|---|---|---|---|
| JP | 2002-270987 | A | 9/2002 |
| JP | 2004-179055 | A | 6/2004 |

(Continued)

*Primary Examiner* — Amy Cohen Johnson
*Assistant Examiner* — Matthew T Dzierzynski
(74) *Attorney, Agent, or Firm* — McDermott Will & Emery LLP

(57) ABSTRACT

A connecting pin for an electronic circuit board electrically connects a lead of a component to be surface-mounted to the electronic circuit board to a coating layer on an inner wall of a through-hole of the electronic circuit board. The connecting pin includes a cylindrical body formed of an electrically conductive metal, which is inserted into the through-hole of the electronic circuit board. The lead of the component is press-fitted, and inner surface of the cylindrical body is provided with a plurality of small protrusions deformable when contacting protrusions of the press-fitted lead.

11 Claims, 4 Drawing Sheets

(56) References Cited

U.S. PATENT DOCUMENTS

| | | | | |
|---|---|---|---|---|
| 2012/0127681 | A1* | 5/2012 | Ryu | H05K 3/3447<br>361/772 |
| 2015/0000976 | A1* | 1/2015 | Frohler | H01R 4/02<br>174/74 R |

FOREIGN PATENT DOCUMENTS

| | | | |
|---|---|---|---|
| JP | 2008-153137 | A | 7/2008 |
| JP | 2012-114394 | A | 6/2012 |
| KR | 10-0808479 | A | 8/2004 |
| KR | 10-2012-0056128 | A | 6/2012 |

* cited by examiner

- Prior Art -

CONNECTING PIN FOR ELECTRONIC CIRCUIT BOARDS

CROSS-REFERENCE TO RELATED APPLICATION

This application claims under 35 U.S.C. §119(a) the benefit of priority to Korean Patent Application No. 10-2014-0025338 filed on Mar. 4, 2014, the entire contents of which are incorporated herein by reference.

TECHNICAL FIELD

The present disclosure relates, in general, to a connecting pin for electronic circuit boards and, more particularly, to a connecting pin for electronic circuit boards, which prevents a coating layer on an inner wall of a through-hole of an electronic circuit board from being damaged, and improves a fastening force applied between a lead of a component, such as a press-fitting connector, a semiconductor package, or the like and the board when the component is surface-mounted on an electronic circuit board so that the lead of the component is press-fitted into the through-hole.

BACKGROUND

Generally, in electronic circuit boards such as printed circuit boards (PCBs) and a press-fit connector has been widely used for connecting terminals.

The press-fit connector connects connector leads into through-holes of the electronic circuit board by press-fitting. Here, the through-hole is formed on the electronic circuit board, and an inner wall of the hole is coated with a conductive metal material so as to form a conductive hole.

Soldering defects may occur generally in the case where the number of leads is high and a distance between leads is narrow, such that, the press-fit connector having the leads which are fixedly connected into through-holes, respectively, is used.

The press-fit connector has the advantages of having a simple connection process, causing no thermal damage on the PCBs and the device parts, requiring no soldering bridge, and consuming less energy because there is no soldering process with respect to leads.

FIG. 1 is a cross-sectional view showing how a press-fit connector is connected to an electronic circuit board such as a PCB. Reference numeral 11 denotes a connector housing and reference numeral 12 denotes a connector lead for the connection with an electronic circuit board 20.

Further, reference numeral 21 denotes a plastic substrate of the electronic circuit board 20, and reference numeral 22 denotes a circuit pattern of the electronic circuit board 20.

As shown in the figure, the connector lead 12 is provided with a wedge portion 13 whose diameter is larger than an inner diameter of a through-hole 24 so that the connector lead 12 is fixedly press-fitted into the through-hole 24 of the circuit board 20 by the connection of the wedge portion 13 with the through-hole 24.

However, the related art has problems in that a coating layer 23 on the inner wall of the through-hole 24 in the circuit board 20 is subjected to damage because of a press-fitting action of the lead 12, and therefore, due to such a risk of the coating layer being damaged, the fastening force cannot be regulated to a specified level or more, resulting in the fastening force becoming weaker.

Particularly, when a press-fitting connector is adapted to a high-voltage specification of an electric vehicle (EV) or a hybrid vehicle, there may be a problem of heating due to degradation of the fastening force.

SUMMARY

The present disclosure has been made keeping in mind the above problems occurring in the related art, and an aspect of the present disclosure provides a connecting pin for an electronic circuit board. When a component such as a press-fitting connector, a semiconductor package, or the like is surface-mounted on the electronic circuit board so that a lead of the component is press-fitted into a through-hole of the electronic circuit board, the connecting pin prevents a coating layer on an inner wall of the through-hole from being damaged and improves a fastening force between the lead and the board.

Another aspect of the present disclosure provides a connecting pin solving the above problems and adaptable to, in addition to the press-fitting connector, other parts such as a semiconductor package which is surface-mounted on an electronic circuit board such as a PCB by way of the through-hole and the lead.

According to an exemplary embodiment of the present disclosure, a connecting pin for an electronic circuit board electrically connects a lead of a component that is to be surface-mounted to the electronic circuit board to a coating layer on an inner wall of a through-hole in the electronic circuit board. The connecting pin includes a cylindrical body made of an electrically conductive metal and inserted into the through-hole of the electronic circuit board. The lead of the component is press-fitted, and inner surface of the cylindrical body is provided with a plurality of small protrusions deformable when contacting protrusions of the press-fitted lead.

An outer surface of the cylindrical body may be in contact with the coating layer on the inner wall of the through-hole in the electronic circuit board and may be further provided with a plurality of small protrusions.

The small protrusions may include knurling protrusions which are spaced apart in an interval on the inner and outer surfaces of the cylindrical body.

The knurling protrusions may have an arrangement angle ($\theta$) ranging from 25° to 65° with respect to an insertion direction of the lead.

The cylindrical body may be provided with, at upper and lower sides thereof, upper and lower engaging parts bent in a radial direction so that the engaging parts of the cylindrical body protrude in a bent form outwardly from the through-hole, preventing the disconnection from the through-hole.

The lower side of the cylindrical body, together with the lower engaging part, may be provided with a plurality of cut-outs at an outer circumference thereof, such that, when the cylindrical body is inserted into the through-hole, the lower engaging part collapses toward a center of the lower side in the radial direction.

The connecting pin may be formed from a metal plate and may be provided, at which the small protrusions are formed, with a surface coating layer to improve corrosion resistance and mechanical properties.

The surface coating layer may be formed by coating the metal plate with any one selected from the group including Sn, Sn—Cu, Sn—Mn, Sn—Bi, Sn—Ag, Au, and Zn.

According to the connecting pin for an electronic circuit board of the present disclosure, the knurling protrusions formed on the inner surface of the connecting pin are deformed by the protrusions of the lead, thereby reducing friction resistance and insertion friction when the lead of the connector is press-fitted into the connecting pin.

Further, the small protrusions of the connecting pin and the protrusions of the lead, which remain undeformed even after the lead is inserted into the connecting pin, are correspondingly engaged with each other, thereby increasing the fastening force with respect to the connector and preventing the disconnection of the connector from the connecting pin due to an external force (e.g. vibration or shock).

Furthermore, the small protrusions on the outer surface of the connecting pin serve to stably fix the connecting pin into the through-hole in the circuit board, thus increasing the fastening force between the through-hole of the circuit board and the connecting pin.

BRIEF DESCRIPTION OF THE DRAWINGS

The above and other objects, features and advantages of the present invention will be more clearly understood from the following detailed description when taken in conjunction with the accompanying drawings.

DETAILED DESCRIPTION

A description will now be made in detail of embodiment with reference to the accompanying drawings such that ordinary persons skilled in the art can easily implement such embodiments.

The present disclosure provides a connecting pin or electronic circuit boards, which, when a component such as a press-fitting connector, a semiconductor package or the like is surface-mounted on an electronic circuit board so that a lead of the component is press-fitted into a through-hole of the electronic circuit board, prevents a coating layer on an inner wall of the through-hole from being damaged, and improves a fastening force between the lead and the board.

Figure 1:
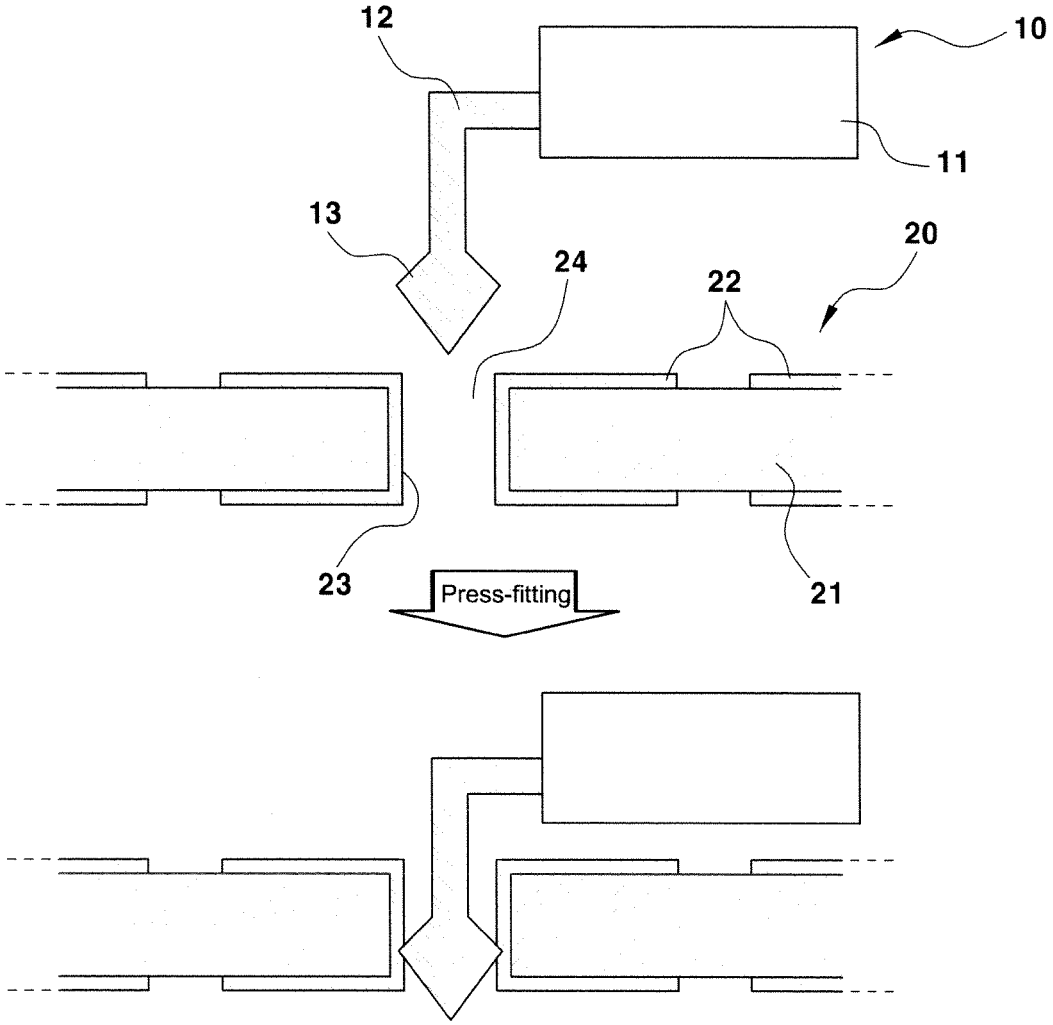
FIG. 1 is a cross-sectional view showing how a press-fitting connector is connected to an electronic circuit board.
Figure 2:
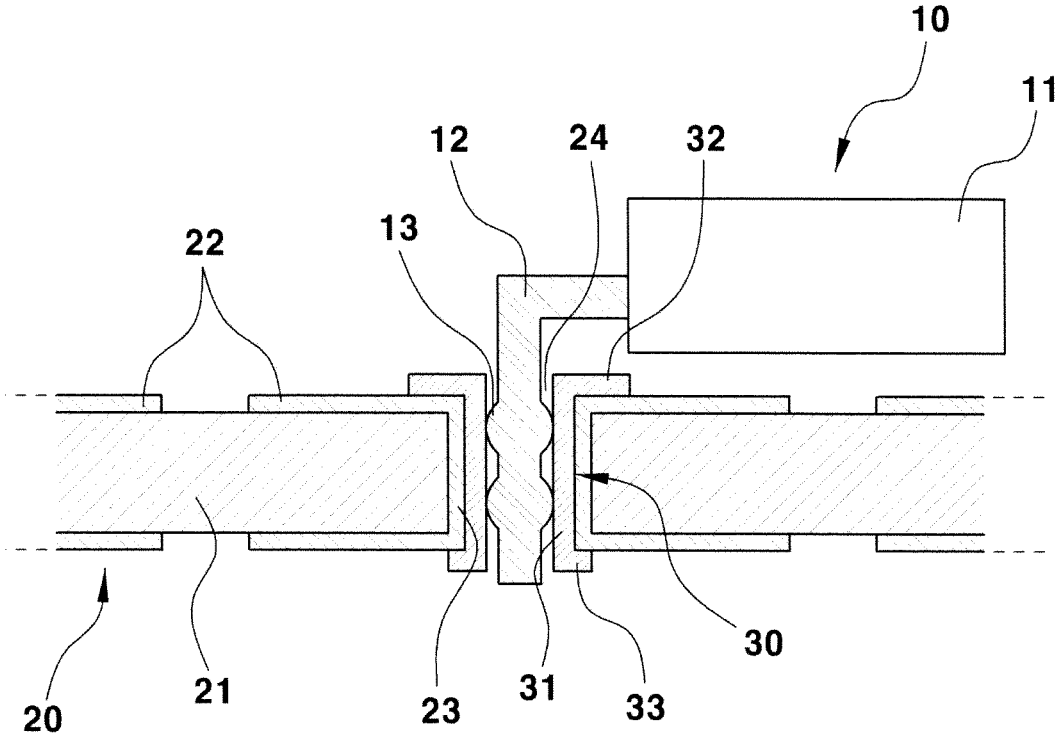
FIG. 2 is a cross-sectional view showing the state where a lead of a press-fitting connector is press-fitted into a through-hole in the electronic circuit board by means of a connecting pin according to an embodiment of the present disclosure.
Figure 3:
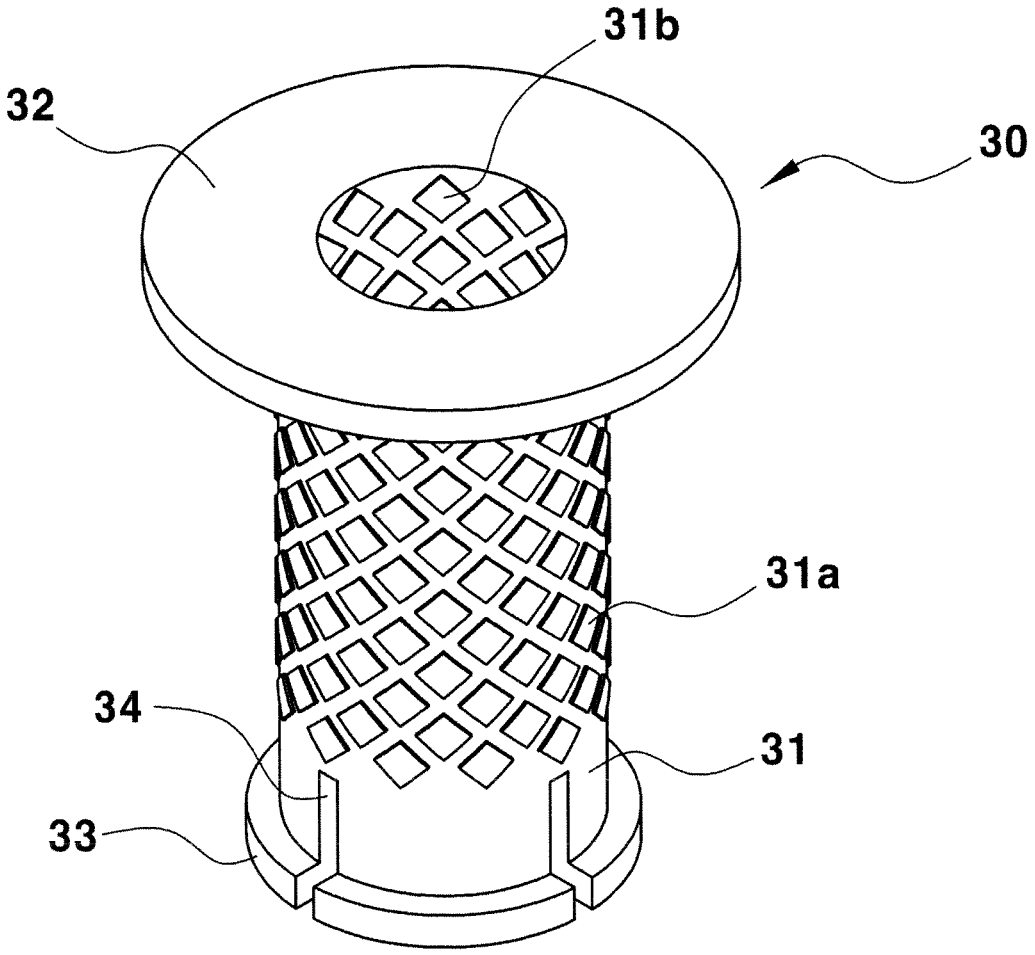
FIG. 3 is a perspective view showing the connecting pin of the present disclosure.

FIG. 2 is a cross-sectional view showing the state where a lead of a press-fitting connector is press-fitted into a through-hole in an electronic circuit board by means of a connecting pin according to an embodiment of the present disclosure, and FIG. 3 is a perspective view showing the connecting pin of the present disclosure.

Figure 4:
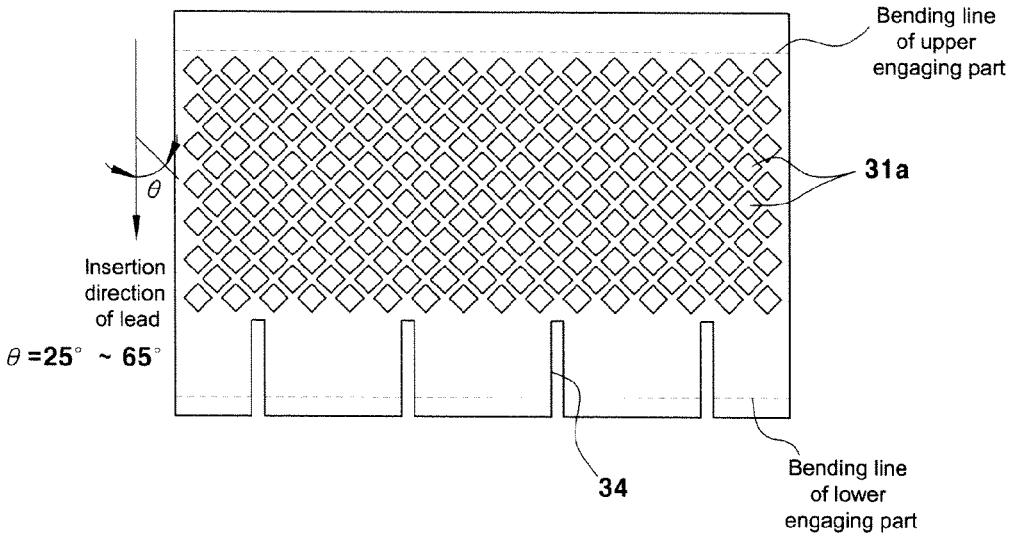
FIG. 4 is a view showing a metal plate having knurling protrusions for fabricating the connecting pin.
Figure 5:
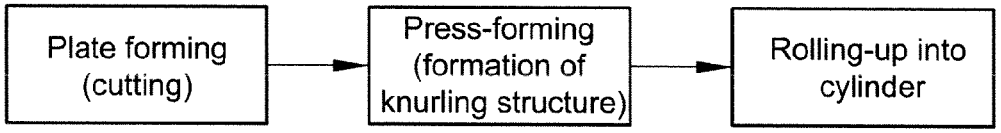
FIG. 5 is a view showing major processes of fabricating the connecting pin.

FIG. 4 is a view showing a metal plate having knurling protrusions for fabricating the connecting pin, and FIG. 5 is a view showing major processes of fabricating the connecting pin.

Although a press-fitting connector will be described as a fastening component by way of example, the component to be connected to an electronic circuit board by the connecting pin of the present disclosure is not limited thereto.

That is, the connecting pin of the present disclosure can be applied to any surface-mounting component which is electrically connected with the electronic circuit board such that, a portion of semiconductor packages and a lead of the component are press-fitted into a through-hole of the electronic circuit board.

As shown in FIGS. 2-4, when connecting a component such as a press-fitting connector 10 to an electronic circuit board 20 (hereinafter referred to as a 'circuit board') such as a printed circuit board (PCB), so that respective leads of the connector 10 are press-fitted into a through-hole 24 of the circuit board 20, a connecting pin 30 of the present disclosure is used as illustrated.

The connecting pin 30 is pre-inserted into the through-hole 24 of the circuit board 20. That is, the lead 12 of the connector 10 is press-fitted into the connecting pin 30 which has previously been inserted into the through-hole 24 of the circuit board 20.

The connecting pin 30 serves to connect the lead 12 of the connector 10 with a coating layer 23 on an inner wall of the through-hole 24, to prevent damage of and protect the coating layer 23 when the lead 12 is press-fitted (serving as a shock-absorbing element and a damper), and to increase a fastening force after the lead 12 is press-fitted.

Here, the coating layer 23 means a portion of the inner wall of the through-hole 24 that is coated with a conductive metal (e.g. copper) in order to electrically connect the lead 12 with a circuit pattern 22 of the circuit board 20. The coating layer has a structure that is electrically connected with the circuit pattern 22 (e.g. a copper circuit pattern).

During the manufacturing the electronic circuit board 20 such as the PCB, the circuit pattern 22 is generally formed by coating the surface of a plastic substrate 21 with a conductive metal (copper), and patterning the conductive metal.

Since the inner wall of the through-hole 24 in the plastic substrate 21 into which the lead 12 of the connector 10 is press-fitted is also coated with the conductive metal, the coating layer 23 on the inner wall of the through-hole 24 is considered as an extension of the circuit pattern 22.

The connecting pin 30 is provided on upper and lower sides thereof with upper and lower engaging parts 32 and 33 which are bent in the radial direction, so that the connecting pin 30 is formed by rolling up a planar metal plate into a cylinder. As shown in FIG. 3, the upper and lower engaging parts 32 and 33 may have a flange shape which continuously extends in a circumferential direction.

The engaging parts 32 and 33 prevent the connection pin 30, which has been inserted into the through-hole 24 of the circuit board 20, from being disconnected from the through-hole 24. That is, the upper and lower engaging parts 32 and 33 serve to prevent the disconnection of the connecting pin 30 from the through-hole at the upper and lower sides of the circuit board 20.

The connecting pin 30 is provided, on an inner surface to be brought into contact with the lead 12 of the connector, with a plurality of small protrusions 31*a*, which are characteristic features according to the present disclosure. In an exemplary embodiment, similar to the inner surface of the connecting pin 30, an outer surface of the connecting pin 30 to be brought into contact with the coating layer 23 on the inner wall of the through-hole 24 may also be provided with a plurality of small protrusions 31*b*.

As shown in FIGS. 3 and 4, the small protrusions 31*a* and 31*b* on the inner and outer surfaces of the connecting pin 30 are each composed of knurling protrusions arranged at regular intervals. The knurling protrusions 31*a* and 31*b* may be previously formed by press-forming in a die before a metal plate, which will be formed into the connecting pin 30, is formed into a cylinder.

The knurling protrusions 31*a* and 31*b* are slightly deformable. Particularly, the knurling protrusions 31*b* formed on the inner surface of the connecting pin 30 are deformed by protrusions 13 of the lead 12 so as to reduce friction resistance and insertion friction when the lead 12 of the connector 10 is press-fitted into the connecting pin 30.

Further, the small protrusions 31*a* and 31*b* of the connecting pin 30 and the protrusions 13 of the lead 12, which remain undeformed even after the lead 12 is inserted into the connecting pin 30, are correspondingly engaged with each other, thereby preventing the disconnection of the connector 10 from the connecting pin 30 due to an external force (e.g. vibration or shock).

In addition, the small protrusions 31*b* on the outer surface of the connecting pin 30 serve to stably fix the connecting pin 30 into the through-hole 24 in the circuit board 20, thus increasing the fastening force between the through-hole 24 of the circuit board 20 and the connecting pin 30.

In an exemplary embodiment, as shown in FIG. 4, the knurling protrusions 31*a* and 31*b* on the inner and outer surfaces of the connecting pin 30 are arranged at an arrangement angle (θ) that ranges from 25° to 65° with respect to an insertion angle of the lead 12.

In such a range of the arrangement angle, the friction force, which is generated when the lead 12 of the connector 10 is inserted into the connecting pin, can be decreased. The friction force becomes excessively larger or smaller beyond the range of the arrangement angle.

As shown in FIG. 3, the connecting pin 30 of the present disclosure is composed of a cylindrical body 31 which has the small protrusions 31*a* and 31*b* on its inner and outer surfaces, and the upper and lower engaging parts 32 and 33 which extend in a radial direction at upper and lower sides of the cylindrical body 31.

The cylindrical body 31 fixedly connects the lead 12 of the connector 10 and the through-hole 24 of the circuit board 20, and the upper engaging part 32 serves to prevent the connecting pin 30 from being moved while the lead 12 of the connector 10 is inserted into the connecting pin 30. As shown in FIG. 2, the upper engaging part 32 extends radially toward outside of the through-hole 24 of the circuit board 20.

The lower engaging part 33 serves to prevent the connecting pin 30 from being disconnected from the through-hole 24 of the circuit board 20 after the lead 12 of the connector 10 is inserted into the connecting pin 30. As shown in FIG. 2, the lower engaging part 33 extends radially toward outside of the through-hole 24 of the circuit board 20.

Since the lower engaging part 33 is fixedly engaged with the lower side of the through-hole 24, the lower engaging part 33 prevents the disconnection of the connector 10 due to an external force.

Further, the lower side of the cylindrical body 31, together with the lower engaging part 33 of the connecting pin 30, may be provided with a plurality of cut-outs 34 at a circumference thereof in order to reduce the friction force generated when the lower engaging part is inserted into the through-hole 24.

The cut-outs 34 are provided at regular distances along the circumference of the lower side of the cylindrical body 31, and cut-outs 34 each provide a gap by which, when the connecting pin 30 is inserted into the through-hole 24 in the circuit board 20, the lower side of the cylindrical body 31 is connected towards the center thereof such that the lower engaging part 33 passes through the through-hole 24 of the circuit board 20.

FIG. 4 is a view showing a metal plate having knurling protrusions 31*a* for fabricating the connecting pin 30. In a fabricating process, the connecting pin 30 is fabricated by cutting the metal plate into an adequate size as shown in FIG. 5. Knurling protrusions 31*a* and 31*b* and cut-outs 34 are press-formed on the cut metal plate. The upper and lower engaging parts 32 and 33 are bent and formed along a bending line shown in FIG. 4, and at the same time, the metal plate is rolled up into a cylinder.

The metal plate forming the connecting pin 30 is composed of a conductive base metal plate on which a coating layer is formed to improve corrosion resistance and mechanical properties at a place where small protrusions 31*a* and 31*b* are formed.

Here, the base metal plate may be formed of an Fe alloy, a Cu alloy, or Cu. Specifically, the base metal plate may be formed of an Fe—Ni alloy, an Fe—Ni—Co alloy, Cu, a Cu—Sn alloy, a Cu—Zr alloy, a Cu—Fe alloy, a Cu—Zn alloy, or the like. Further, the base metal plate may be surface plated after under-plating of Cu or Ni, and the surface plating may be performed with Sn, Sn—Cu, Sn—Mn, Sn—Bi, Sn—Ag, Au, or Zn.

Although an exemplary embodiment of the present disclosure has been described for illustrative purposes, those skilled in the art will appreciate that various modifications, additions and substitutions are possible, without departing from the scope and spirit of the invention as disclosed in the accompanying claims.

What is claimed is:

1. A connecting pin for an electronic circuit board, wherein the connecting pin electrically connects a lead of a component that is to be surface-mounted to the electronic circuit board to a coating layer on an inner wall of a through-hole of the electronic circuit board, the connecting pin including:

a cylindrical body formed of an electrically conductive metal and inserted into the through-hole of the electronic circuit board, wherein the lead of the component is press-fitted, and an inner surface of the cylindrical body is provided with a plurality of small protrusions deformable in the shape when contacting protrusions of the press-fitted lead, wherein the small protrusions on the inner surface of the cylindrical body comprise knurling protrusions which are spaced apart in an interval on the inner surface of the cylindrical body, and wherein the knurling protrusions are tilted at an angle (θ) ranging from 25° to 65° along the inner surface of the cylindrical body with respect to an insertion direction of the lead.

2. The connecting pin for an electronic circuit board according to claim 1, wherein an outer surface of the cylindrical body is in contact with the coating layer on the inner wall of the through-hole and is further provided with a plurality of small protrusions.

3. The connecting pin for an electronic circuit board according to claim 2, wherein the small protrusions on the outer surface of the cylindrical body comprise knurling protrusions which are spaced apart in an interval on the outer surface of the cylindrical body.

4. The connecting pin for an electronic circuit board according to claim 3, wherein the knurling protrusions are tilted at an angle (θ) ranging from 25° to 65° along the inner surface of the cylindrical body with respect to an insertion direction of the lead.

5. The connecting pin for an electronic circuit board according to claim 2, wherein the connecting pin is formed from a metal plate and is provided, at which the small protrusions on the outer surface of the cylindrical body are formed, with a surface coating layer to improve corrosion resistance and mechanical properties.

6. The connecting pin for an electronic circuit board according to claim 5, wherein the surface coating layer is formed by coating the metal plate with any one selected from the group consisting of Sn, Sn—Cu, Sn—Mn, Sn—Bi, Sn—Ag, Au, and Zn.

7. The connecting pin for an electronic circuit board according to claim 1, wherein the cylindrical body is provided with, at upper and lower sides thereof, upper and lower engaging parts bent in a radial direction so that the engaging parts of the cylindrical body protrude in a bent form outwardly from the through-hole, the engaging parts preventing the disconnection from the through-hole.

8. The connecting pin for an electronic circuit board according to claim 7, wherein the lower side of the cylindrical body, together with the lower engaging part, is provided with a plurality of cut-outs at an outer circumference thereof, such that, when the cylindrical body is inserted into the through-hole, the lower engaging part collapses toward a center of the lower side in the radial direction.

9. The connecting pin for an electronic circuit board according to claim 1, wherein the connecting pin is formed from a metal plate and is provided, at which the small protrusions on the inner surface of the cylindrical body are formed, with a surface coating layer to improve corrosion resistance and mechanical properties.

10. The connecting pin for an electronic circuit board according to claim 9, wherein the surface coating layer is formed by coating the metal plate with any one selected from the group consisting of Sn, Sn—Cu, Sn—Mn, Sn—Bi, Sn—Ag, Au, and Zn.

11. The connecting pin for an electronic circuit board according to claim 1, wherein the coating layers on the inner wall of the through-hole is coated with a conductive metal to electrically connect the lead with a circuit pattern of the electronic circuit board.

* * * * *